United States Patent [19]

Pearse et al.

[11] 3,983,675

[45] Oct. 5, 1976

[54] ROOFING MEMBER

[75] Inventors: Thomas R. Pearse, St. Georges; John S. Allison, Surrey Hills, both of Australia

[73] Assignee: Rooftilers (Vic.) Pty. Ltd., Adelaide, Australia

[22] Filed: May 27, 1975

[21] Appl. No.: 580,779

[52] U.S. Cl. ..... 52/533; 52/522

[51] Int. Cl.[2] ..... E04D 1/00

[58] Field of Search ..... 52/74–78, 52/518, 519, 522, 528–534, 539, 553, 748

[56] References Cited

UNITED STATES PATENTS

| | | | |
|---|---|---|---|
| 2,211,508 | 8/1940 | Little | 52/533 |
| 3,120,082 | 2/1964 | Mendelsohn | 52/534 X |
| 3,157,003 | 11/1964 | Domar | 52/534 X |
| 3,375,622 | 4/1968 | Murray | 52/533 X |
| 3,629,988 | 12/1971 | Zylstra | 52/534 X |

*Primary Examiner*—J. Karl Bell

*Attorney, Agent, or Firm*—Wofford, Felsman, Fails & Zobal

[57] ABSTRACT

An improved roofing member for use with other similar roofing members in an overlapping relationship which has upper and lower webs which when two roofing members are engaged one on the other defining between them a transverse cavity which forms a combined air expansion chamber and water trap such a cavity being formed also at the overlap of a pair of members, whereby to form a water meniscus at the joint to restrict air flow into the cavity and water flow through the joint. A special alignment configuration forms part of the webs.

15 Claims, 12 Drawing Figures

Figure 7:
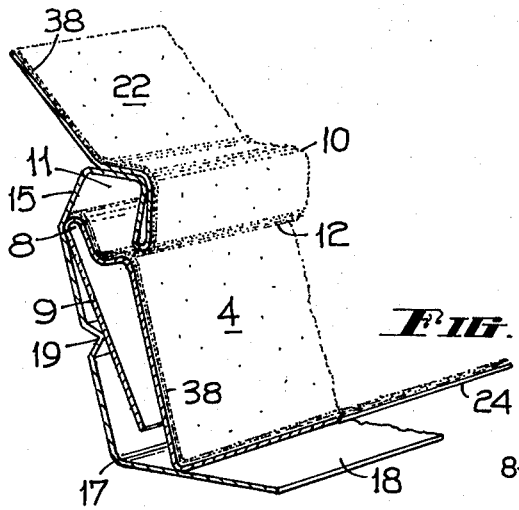

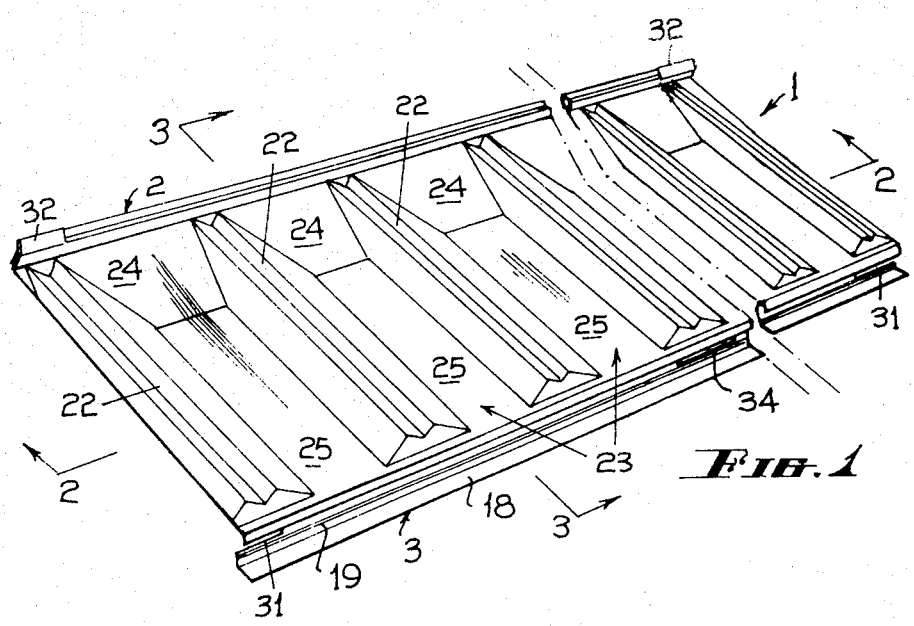
FIG. 1
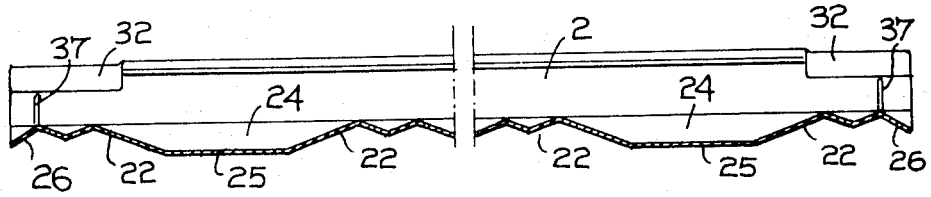
FIG. 2
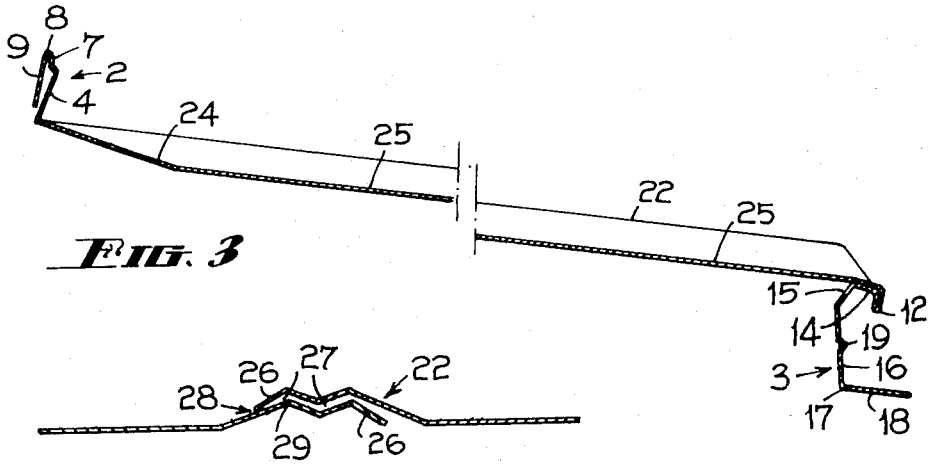
FIG. 3
FIG. 4

ROOFING MEMBER

This invention relates to an improved roofing member, and in particular it relates to a tile formation.

In the construction of roofing members, particularly those which are in the nature of metal tiles, certain difficulties exist, the chief of these being to achieve the required rigidity because of the tendency of persons to walk on roofs and the second and probably the major feature being the need to obtain an effective seal against the ingress of water.

As the pitch of a roof can vary considerably and at times a relatively low angle is involved, the sealing against the ingress of water can become a major problem with any form of tile for the reason that with wind gusts of relatively high velocity, in the direction of or across the upward slope, the water is driven upwardly or along the roof as well as flowing down the roof, and the water can therefore be forced, with considerable energy, into crevices or joins between the tiles.

The problem is particularly critical at those areas where tiles join with a limited degree of overlap, because to overlap the tiles it is generally necessary to provide cut-outs where the edge portions and corners of the tiles overlap, and the problem of obtaining a seal at this location is further aggrevated because there are two tiles overlapping at such a junction and the edges of these engage a third tile, generally centrally to give the required pattern necessitating quite intricate shapes to allow the tiles to overlap correctly, yet to fit together without leakage or spoiling the appearance of the structure.

Another problem which exists generally with this type of tile is the need to provide a series of horizontal purlins on the downward sloping rafters so that the tiles can be fixed to the purlins to have the necessary strength to, for instance, support people walking on a roof, and an improvement resulting from the present invention ensures that adequate strength can be obtained so that the roofing members can be supported directly on the rafters running from the top of the roof downwardly along the slope of the roof, and these rafters can be spaced at quite considerable distances apart due to the particular type of interlock between the roofing members which at the same time as ensuring good sealing against the ingress of water to beneath the roof, form rigid transverse members of considerable extension so that the purlins can if desired, be omitted.

One of such improvements is a particular interlock between the upstanding web of one tile and the downformed web of an engaging tile, which interlock includes a water trap and air expansion chamber defined by forming a downwardly opening transverse channel terminating in a lip along an intermediate portion of the downformed web and shaping the top portion of the upstanding web so that it engages said lip but continues upwards to form a wall spaced from that part of the channel above the lip to terminate in the upper part of the channel, whereby to form a water trap cavity which sheds water forced into it past said lip back past said lip, said cavity being dimensioned to form an air expansion chamber whereby air forced into said cavity past said lip by wind pressure is reduced in velocity, but wherein a meniscus is formed due to the devergent surfaces upwards from the gap at such lip to prevent water from the cavity from being driven over the said wall.

A further improvement is achieved by having the wall engage an inner wedge surface of the cavity.

A further improvement is achieved by having an outwardly defined transverse ridge in the downformed web between the channel and its lower edge which is engaged by the rear down turned part of the upstanding web to aid the seal but to act as a fulcrum for the springy upstanding wedge to force the web into contact with the lip.

A still further improvement relates to a slit in each end of the downformed web which allows two transversely positioned tiles to overlap, and the flattening and shaping of the ends of the upstanding webs to fit into the slits and effect a seal, and also to form lateral location means for the tiles when positioning.

A still further improvement relates to stiffening deformations extending down the tile which form rises to prevent water flow transversely across the tiles and through between the sides of adjacent tiles, the deformations being such that a steeper angle exists at the tile junctions to ensure better water shedding and the side edges of the tiles are formed to give air expansion means to break capillary flow, and to form a meniscus at this locality.

These and other objects will be apparent from the following description of a preferred embodiment which will be made with reference to the accompanying drawings which are however not to form a limitation, the scope of the invention being defined by the claims.

Figure 5:
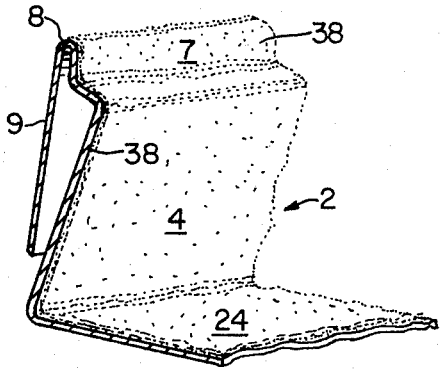
Figure 8:
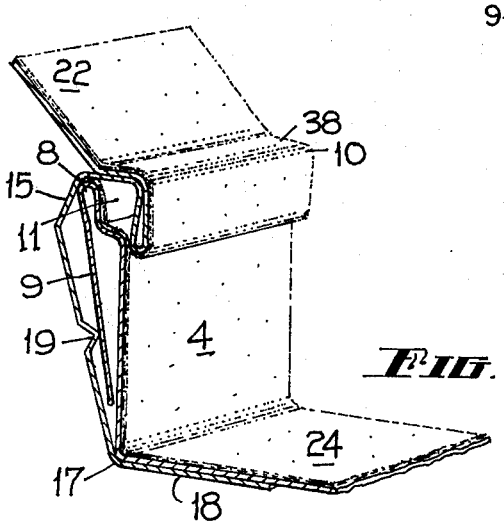
Figure 9:
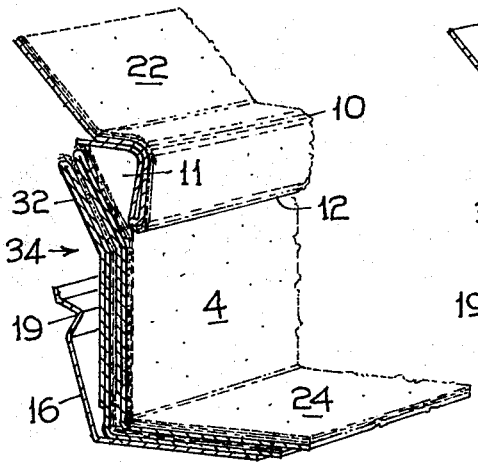
Figure 10:
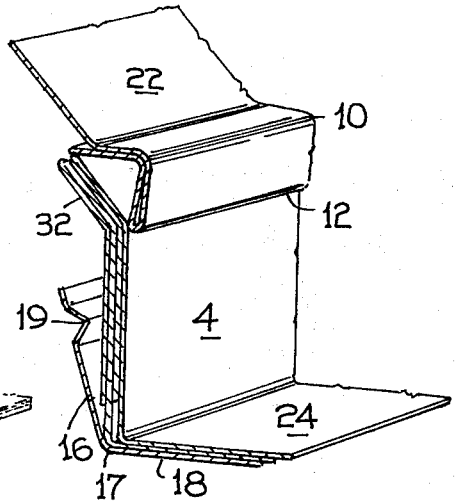
Figure 11:
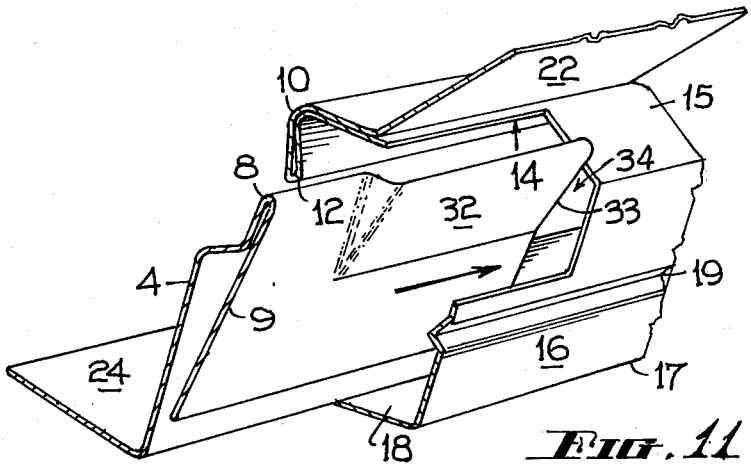
Figure 6:
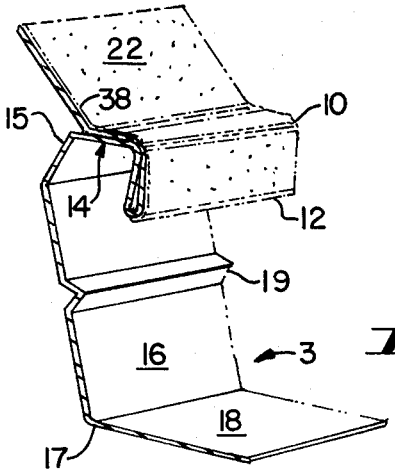
Figure 12:
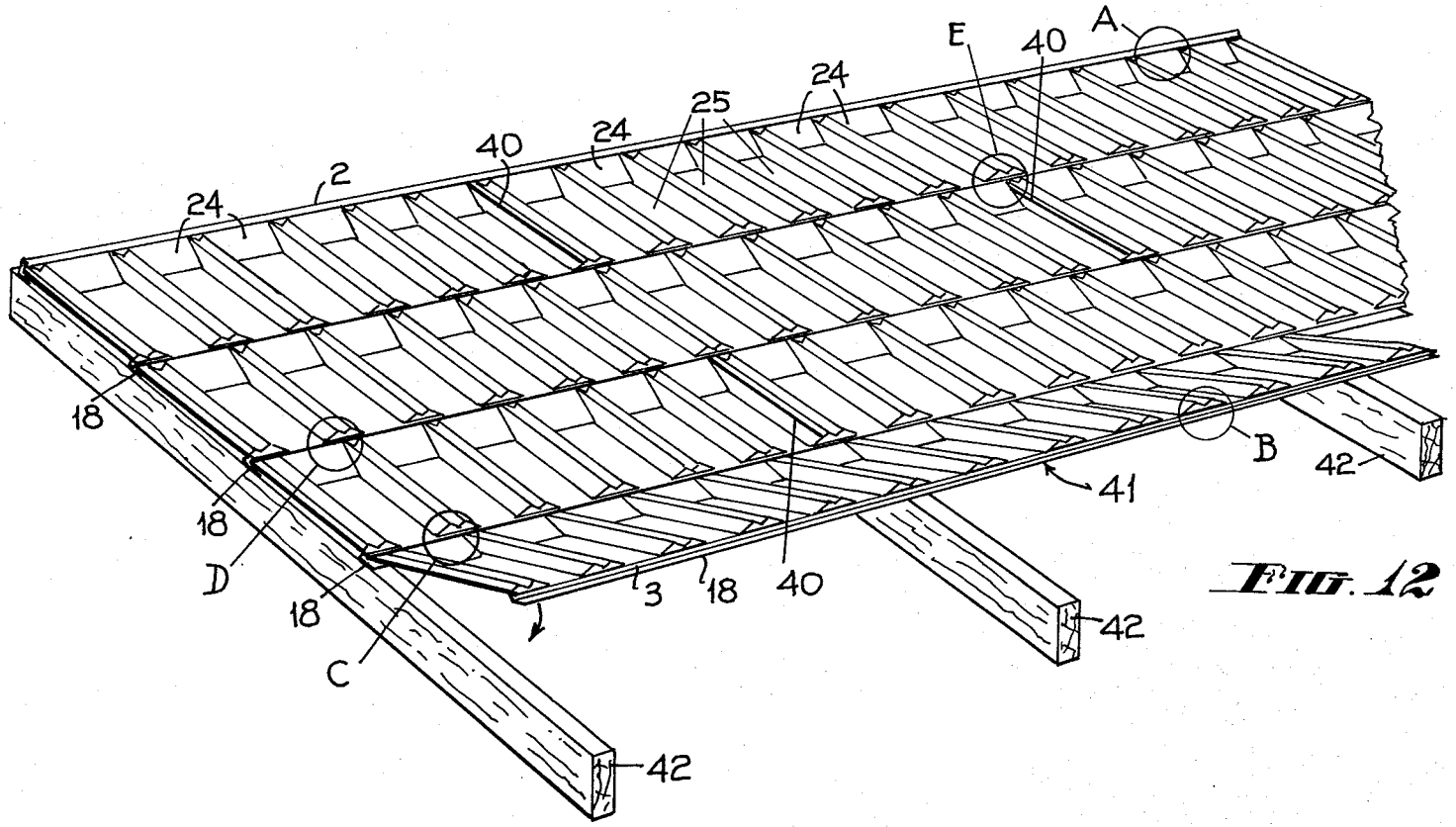

In the drawings:

FIG. 1 is a perspective top view of part of a tile,

FIG. 2 is an enlarged longitudinal section of the two ends of same on line 2—2 of FIG. 1, FIG. 3 is an enlarged transverse section of the two side portions of same on line 3—3 of FIG. 1, FIG. 4 is a fragmentary section showing the side overlap, FIG. 5 is an enlarged section showing the upformed web along the upper edge of each tile, the tile being shown as having a decorative coating on its outside surface, as at A of FIG. 12, FIG. 6 is a similarly enlarged upstanding web showing the lower edge of the tile, as at B of FIG. 12, FIG. 7 is a view showing how the upstanding web of one tile is engaged in the downformed web of another tile prior to positioning the lower tile in its final location, as at C of FIG. 12, FIG. 8 shows the relationship of the upstanding and downformed webs when the tile is in its final position, as at D of FIG. 12, FIG. 9 is a section showing how the ends of a pair of tiles engage an associated tile, this view showing the slit and cooperating flattened portions which form the locating means as well as allowing overlap of the tiles, as at E of FIG. 12, FIG. 10 is a view corresponding to FIG. 7 showing how the bends at the end sections of the tiles are modified when such tiles are formed only of metal without a decorative layer thereon, the illustrations 5 to 9 having such a decorative layer, FIG. 11 is a fragmentary view showing how two tiles are indexed one in relation to the other during fitting, the view indicating how, when the one tile is tilted to engage the upformed web on it beneath the downformed web, movement in the direction of the arrow causes engagement of the shaped end of an upstanding web against the edge of the slit in the downformed web reverse movement having a similar action at the other end of the slit, and FIG. 12 is a perspective view showing a section of a roof with tiles fitted thereon, one of said tiles being in the position where it is first engaged on adjacent tiles prior to swinging it down into its final position.

In the form illustrated, the tile has a main body section 1, of greater lateral dimension than down the slope, and has an upstanding web 2 along its upper edge and a downformed web 3 along its lower edge, the upstanding web being formed by first turning a portion 4 of the main body section in a direction upwardly at approximately right angles to the body of the tile, then turning it outwardly at 5 and then upwardly at 6 to form a wall 7 and then downwardly at 8 to form the portion 9 behind the part 4 of the upstanding web 2 but not down to the plane of the body of the tile. The portion 9 is apart from the portion 4 and results in a springy but strong structure, the double thickness giving greatly increased strength in the plane of the web 2.

The downformed web 3 at the other end of the sheet is formed by bending the sheet down at 10 and back on itself some distance from the edge of the sheet, this portion forming the forward part of a downwardly opening channel which defines the front and top wall of a cavity 11 having a lip 12 at the return bend. The sheet then has an inward extension 14 and turns down to form a wedge portion 15 and then downwardly at approximately the same angle as the rear portion 9 of the upstanding web 2 at the other end of the sheet, this part being designated 16, and it is then bent at 17 substantially into the plane of the body of the tile to form the fixing member 18 through which the tile is secured to a rafter. The centre part of the downwardly extending portion 16 has an outwardly defined ridge 19 along it which, when two sheets are inter-engaged, is in contact with the extreme back portion of the upstanding web 2 of that tile which is engaged into the cavity 11, the ridge 19 forming a fulcrum for the part 9 of the upstanding web 2 to force the web 2 into tight contact with the lip 12 to cause a meniscus to be formed when water is present.

From the foregoing it will be realized that, when tiles are interengaged, there are three thicknesses of the metal formed by the webs 2 and 3 in a plane which, in use, is substantially vertical.

The cavity 11, at the top of the triple thickness structure so formed is closed linearly at its lowermost point by the lip 12 engaging the web 2 and is closed linearly at a higher point by the bend 8 engaging the inward extension 14 or the wedge portion 15.

In this way a meniscus can be formed at the junction of the upstanding web 2 with the lip 12, and a small amount of water can be held in the cavity 11 but as the rear wall of the cavity extends upwardly and contacts the downformed web 3 at a line considerably above the position where water can be trapped, no flow takes place over the upper edge of the upstanding web, firstly because of its raised position, and secondly because at this stage any wind flow through the cavity is decreased in velocity by expansion within the cavity.

It will be seen that the cavity 11 is so formed that any water which can enter this cavity drains from the cavity through the line of contact at the lip 12 and then flows along the outside of the upstanding web of the lower tile and along the surface of the tile to discharge therefrom.

The tiles have a series of stiffening deformations 22 between the two webbed edges 2 and 3 which deformations act as stiffeners but also limit lateral water flow. They also form water flow channels 23 which have a lead section 24 at a steeper angle than the main surface 25 of each channel so formed, this tending to drain water faster from the vicinity of the web 2.

To connect adjacent tiles in the same lateral layer together with the required water-shedding overlap, the stiffening deformations 22, which are each in the form of a flattened M extend to the lateral edges of the tile (see FIG. 4) and as all tiles are symmetrical in shape, the next tile can be engaged with its M-shaped portion overlapping the tile below. The extreme edges 26 are bent at a steeper angle to form a cavity 27 to again give a meniscus at 28 which is lower than the top 29 of the associated ridge.

To enable a pair of tiles in the same lateral plane to overlap and still allow their upstanding ridges 2 to be engaged in the downformed ridge 3 of an associated tile, each of the tiles has a slit 31 extending inwards a distance slightly greater than the required overlap, each slit 31 being formed to leave a space into which the edge portion of the overlapping tiles can project.

When the tiles are assembled on a roof, the flattened portions 32 on each tile fit into the downwardly opening channel which defines the front of the cavity 11 formed by the downwformed web, the two tiles fitting into the said channel in overlapping relationship as shown in FIGS. 9 and 10 the flattened portions 32 being appropriately shaped to form with the forward channel forming wall of the downformed web 3 a space which is a continuation of the cavity 11, so that here also the meniscus is formed at a line at the lower part of the cavity 11. FIG. 10 shows the change in shape when the tiles are of plain metal without a coating.

A slit 34 is formed at the centre of each of the tiles. This forms a gauge or positioning member when the tiles of adjacent rows are assembled in staggered relationship which is the normal form of assembly. FIG. 11 shows how the flattened portion 32 projects back in the slit 34 so that when the tile with the flattened portion 32 is pushed in the direction of the arrow in FIG. 11, the edge 33 contacts the end of the slit 34 to accurately position the tile. The flattened portion can locate in either direction. It follows that a tile with a flattened portion when pushed from the other side is again correctly located.

As stated earlier, the two overlapping surfaces of tiles are held slightly apart by the tension applied by the steeper downwardly formed extreme edges 26 of the tiles to ensure that a seal is formed at the extreme outer edge of the tiles and the portion extending beneath this outer edge has a sufficient space 27 between the two tiles to prevent water moving along by capillary action.

This same principle can be applied at other points of the tile, and also preferably applies at the upper edge of the M-shaped stiffening deformations where the raised portions meet the upstanding web, the upstanding web having slightly outwardly distorted portions at the locations marked 37 in FIG. 2. These ensure that any flow of water along the outer face of the upstanding web 2 in a lateral direction will be discouraged.

In the case of the sections designated FIGS. 5 to 9 the decorative or protective layer is designated 38, but in FIG. 10 is shown the shape of the flattened portions when plain metal tiles are involved.

In FIG. 12 is shown particularly how tiles of a relatively long lateral extension can be used on a roof.

In these figures the joints between laterally positioned tiles are designated 40, and it will be seen that the tile 41 is being positioned.

The rafters are designated 42, and it will be seen how, because of the strong lateral junctions between tiles, substantial spans can be covered by fixing the tiles directly to the rafters 42 by nailing or otherwise securing the fixing members 18 to the rafters.

It will be realized from the foregoing that improvements to the tiles generally consist in the method of interlocking such tiles by engaging an upstanding web of one tile in a downformed web on the previously fitted tile.

We claim:

1. An improved roofing member for use with other similar roofing members in an overlapping relationship which comprises a main body portion, an upstanding web along one edge, a downformed web along the opposite edge, the said webs of two roofing members when engaged one on the other defining between them a transverse cavity which forms a combined air expansion chamber and water trap having a water discharge point at a lip outwardly of said upstanding web and lower than a water overflow point, said chamber being defined by forming a downwardly opening transverse channel terminating in a lip along an intermediate portion of the down turned web and shaping the top portion of the upstanding web so that it engages the said lip linearly but continues upward to form a wall spaced from that part of the channel above the lip to terminate in the upper part of the channel, said upstanding web engaging the said downformed portion linearly behind the said cavity to press the said upstanding web against the said lip, whereby to form a water meniscus at said lip to restrict air flow into said cavity and water flow over the top portion of the upstanding web under adverse wet and windy conditions.

2. An improved roofing member according to claim 1 wherein the top of the upstanding web engages linearly a wedge portion on the downformed portion which is angled to engage the top of the upstanding wedge and urge it toward the said lip of the roofing member as it is moved into engagement with the associated member.

3. An improved roofing member according to claim 1 wherein the said chamber is defined by forming a downwardly opening transverse channel along an intermediate portion of the down turned web and turning over the top portion of the upstanding web and then turning it down so that it engages the said channel and has a double thickness to form with the channel a transverse stiffener along the said roofing member.

4. An improved roofing member according to claim 1 wherein the upstanding web of the one roofing member is engaged at least two linear transverse locations by the roofing member to which it is being attached, the first location being the aforesaid lip, and the other location being at a ridge which engages the rear of the said upturned portion to form a fulcrum during positioning of the upformed ridge in the downwardly opening channel said interengaging members being bent to form loading means for maintaining contact at the said lip.

5. An improved roofing member according to claim 4 characterised in that the upstanding portion is double walled and is formed to have a rising portion the upper part of which is adapted to engage the said lip, the top of the rising portion extending rearwardly and then upwardly and then down to form a wall portion spaced rearwardly of the said rising portion, lying substantially parallel to the upstanding portion, the said latter downwardly extending portion defining a springy structure which, when engaged by said ridge on the down turned portion, urges the upstanding portion of the said web into contact with the said lip.

6. An improved roofing member according to claim 1 characterised by a slit intermediate the ends of the down turned web, and flattened portions on the upstanding web at each end thereof of a length substantially that of the said slit whereby when the upstanding web of one such roofing member is engaged in the downwardly opening channel of an associated roofing member, the said flattened portion is engaged in said slit and locates said roofing member.

7. An improved roofing member according to claim 1 characterised by slits at each end of the down turned web, and corresponding flattened portions on the upstanding web at each end thereof whereby when the upstanding web of one such roofing member is engaged in the downwardly opening channel of an associated roofing member, the said flattened portions overlap to form with the down turned portion, the said cavity.

8. An improved roofing member according to claim 7 wherein the down turned web of said roofing member has a central slit to engage the said flattened portions of two overlapping members whereby to serve as aligning means for the ends of said roofing members when the said overlapping ends engage the said central slit and also to seal said slits against water flow therethrough.

9. An improved roofing member according to claim 1 wherein the main body portion has a series of stiffening deformations extending substantially between the upstanding web of said member and the down turned web of said member and wherein the stiffening deformations are so formed that end stiffening deformations on each member are complementary when two said members are overlapped in lateral alignment.

10. An improved roofing member according to claim 9 in which the end deformations at the extreme edges of the said members are shaped to engage the associated member to prevent the members from contacting at the overlap excepting at the said edge whereby to separate the members to form a cavity and whereby a meniscus is formed at the outer end of said cavity to restrict air flow into said cavity and to restrict water flow over a raised part of the stiffening deformation within the overlap under adverse wet and windy conditions.

11. An improved roofing member according to claim 6 wherein the deformations have a flattened M shape.

12. An improved roofing member according to claim 9 wherein the stiffening deformations are upstanding from the main body portion of each roofing member and extend to the upstanding web whereby to discourage lateral water flow.

13. An improved roofing member according to claim 9 wherein the stiffening deformations are upstanding from the main body portion of each roofing member, and the surface between said stiffening deformations slopes downward from the said upstanding web at a greater angle than the remaining surface whereby to shed water more effectively near the join formed between said upstanding web and said downformed web.

14. An improved roofing member for use with other similar roofing members in an overlapping relationship which comprises a. a main body portion, b. an upstanding web along one transverse edge formed by extending an edge portion of the sheet upwards and then rearward and upward to form a rising wall and then downwards to form a rear part which can be sprung towards the first upwardly projecting part, c. a downformed web along the opposite edge of the said main body portion formed by extending down the edge portion of the main body portion and doubling back to form a downwardly projecting channel having a wedge portion at the upper rearward part of the channel and extending down but including in the downward extension a transverse fulcrum ridge, and then extending substantially in the plane of the main body to form fixing means for the roofing member, d. a series of stiffening deformations in the surface substantially between the upstanding web and the down turned web of the said member; the said stiffening deformations being so formed that when the edges of two sheets are overlapped the stiffening formations at the overlap are substantially complementary, the dimensioning of the said webs being such that when the said upstanding web along one edge is engaged in the downformed web along the opposite edge, the webs defined between them a transverse cavity which forms a water trap and air expansion chamber, the said chamber being closed at an outer part by linear engagement between a part of the upstanding web against a forward lip of the transverse channel on the downformed web while the rearward portion of the upstanding web engages at least the fulcrum portion of the downwardly opening channel; whereby to form a water meniscus at the said lip to restrict air flow into said cavity and water flow over the top portion of the upstanding web under adverse wet and windy conditions.

15. An improved roofing member according to claim 14 characterised by a slit at each end of the down turned web and a central slit therein, and corresponding flattened portions on the upstanding web at each end thereof, whereby when the upstanding web of one such roofing member is engaged in the downwardly opening channel of an associated roofing member, the flattened portions engage in said central slit, whereby to form aligning means for the ends of the said roofing members when the said overlapping ends engage the said central slit and to seal said slit against water flow therethrough.

* * * * *